US005284220A

United States Patent [19]

Shimizu et al.

[11] Patent Number: 5,284,220

[45] Date of Patent: Feb. 8, 1994

[54] PRESSURE CONTROL VALVE ASSEMBLY FOR HYDRAULIC CIRCUIT AND AUTOMOTIVE REAR WHEEL STEERING SYSTEM UTILIZING THE SAME

[75] Inventors: Hideaki Shimizu; Shinya Matsumoto, both of Kanagawa, Japan

[73] Assignee: Atsugi Unisia Corporation, Japan

[21] Appl. No.: 845,845

[22] Filed: Mar. 6, 1992

Related U.S. Application Data

[63] Continuation of Ser. No. 461,920, Jan. 8, 1990, abandoned, which is a continuation-in-part of Ser. No. 384,800, Jul. 25, 1989, abandoned.

[30] Foreign Application Priority Data

Jul. 25, 1988 [JP] Japan ..... 63-98180[U]
Jan. 10, 1989 [JP] Japan ..... 1-1321[U]

[51] Int. Cl.[5] ..... F15B 13/044

[52] U.S. Cl. ..... 180/140; 91/429; 137/330; 137/544; 137/625.65; 180/142

[58] Field of Search ..... 137/625.65, 544, 330; 180/140, 142; 91/429

[56] References Cited

U.S. PATENT DOCUMENTS

| | | | |
|---|---|---|---|
| 2,734,523 | 2/1956 | Wiggans | 137/544 X |
| 3,029,830 | 4/1962 | Klover et al. | 137/625.62 X |
| 3,209,782 | 10/1965 | Wolpin et al. | 137/625.62 |
| 4,396,037 | 8/1983 | Wilcox | 137/625.65 |
| 4,406,307 | 9/1983 | Loup et al. | 137/625.65 |
| 4,478,250 | 10/1984 | Lukasczyk et al. | 137/625.65 |
| 4,643,225 | 2/1987 | Imhof | 137/625.65 X |
| 4,662,605 | 5/1987 | Garcia | 137/625.65 X |
| 4,778,147 | 10/1988 | Kozuka et al. | 137/625.65 X |
| 4,781,262 | 11/1988 | Nakamura et al. | 180/140 |
| 4,821,773 | 4/1989 | Herion et al. | 137/625.65 |
| 4,832,082 | 5/1989 | Hirata et al. | 137/625.66 |

FOREIGN PATENT DOCUMENTS

| | | | |
|---|---|---|---|
| 3633312 | 4/1988 | Fed. Rep. of Germany | 137/625.65 |
| 63-208911 | 8/1988 | Japan | 137/625.65 |

*Primary Examiner*—Gerald A. Michalsky
*Attorney, Agent, or Firm*—Ronald P. Kananen

[57] ABSTRACT

In a pressure control valve, a filter member is disposed in a feedback path for feeding back fluid pressure in the corresponding control port to a pilot chamber for feedback controlling a position of the valve spool in cooperation with an electric or electromagnetic actuator. The filter member is so arranged as to remove foreign matter. The filter member also serves for regulating fluid flow in the feedback path.

12 Claims, 5 Drawing Sheets

PRESSURE CONTROL VALVE ASSEMBLY FOR HYDRAULIC CIRCUIT AND AUTOMOTIVE REAR WHEEL STEERING SYSTEM UTILIZING THE SAME

CROSS REFERENCE TO THE RELATED APPLICATION

This application is a continuation of application Ser. No. 07/461,920 filed Jan. 8, 1990, now abandoned, which was a continuation-in-part of application Ser. No. 07/384,800, filed Jul. 25, 1989, now abandoned.

BACKGROUND OF THE INVENTION

1. Field of the Invention

The present invention relates generally to a pressure control circuit for a hydraulic circuit for controlling discharge pressure for a pair of hydraulic loads. More specifically, the invention relates to a pressure control valve which successfully prevent foreign matters which may cause blocking of a hydraulic circuit and/or hydraulic load from flowing into the hydraulic load. The present invention also relates to a technology for ventilating air introduced into the hydraulic circuit and minimizing effect of a residual air in the hydraulic circuit for damping vibration of valve spool.

2. Description of the Background Art

Pressure control valves have been employed in various hydraulic circuits for controlling hydraulic pressure distribution for loads. For example, one of typical construction of pressure control valves can be seen in "Uchida Lexloss direct type electromagnetic proportioning valve" shown in its catalog, May, 1986, published by K. K. Silver Design.

The conventionally proposed pressure control valve defines an induction port, a drain port, a first control port and a second control port, which ports are communicated with a valve bore defined in a valve body. A valve spool is thrustingly disposed within the valve bore for distributing working fluid introduced through the induction port to the first and second control ports. The valve spool is loaded by a pair of bias springs so as to be biased toward a neutral position. A pair of electrically or electromagnetically operable actuators are provided for driving the valve spool for causing an axial shift for controlling distribution of the working fluid to the first and second control ports.

Control current to be applied to the actuators is so controlled as to cause axial shifting of the valve spool for adjusting distribution of the pressure for the first and second control ports in an inversely proportional fashion. During pressure distribution control in such pressure control valve, control pressure to be supplied to respective loads by way of the first and second control ports varies according to non-linear characteristics in a second order curve. These variation characteristics of the control pressure are caused by a simultaneous variation of path areas at an introduction side and a drain side. Therefore, in case that a load is an actuator, activity of the actuator varies as a second order function of the valve spool stroke. This makes control of the actuator by supplying the control pressure difficult in that requiring a complex arithmetic operation becomes necessary. Particularly, at the valve spool position in the vicinity of a completely shutting position a variation of control pressure versus the valve spool stroke becomes substantial to cause an impulsive change in the actuator.

Furthermore, foreign matter may contained in the working fluid to circulate therewith through the hydraulic circuit and through small gaps defined between components of the pressure control valve assembly. Such foreign matter tends to enter into the small gaps between the components for providing resistance against movement of the components. For example, when the pressure control valve is provided a pilot piston for adjusting pilot pressure in the pressure control valve for determining the valve spool position so that the pilot pressure is cooperating with the mechanical spring force and the force exerted on the valve spool by means of an electromagnetic actuator are to be balanced, the foreign matter entering the small gap prevents the pilot valve from shifting smoothly to cause degradation of response characteristics.

Additionally, as can be appreciated, residual air in the hydraulic circuit often affects for performance of the pressure control valve. Particularly, when dither current is superimposed on a control current supplied to an elecromagnetic actuators so as to minimize resistance of movement of a valve spool, vibration of the valve spool caused by dither current tends to amplify noise when residual air is present in the hydraulic circuit or in the pressure control valve. Removal or ventilation of the residual air in the pressure control valve has been typically performed by removing a closure plug in a ventilation path. This process is cumbersome. In addition, a difficulty is encountered in removing the air when the air resides in the orientation remote from the ventilating opening of the ventilation path.

SUMMARY OF THE INVENTION

Therefore, it is an object of the present invention to provide a pressure control valve which enables an easy setting of load activity in relation to a valve position.

Another object of the invention is to provide a pressure control valve which may prevent foreign matter contained in the working fluid from entering into a load.

A further object of the invention is to provide a pressure control valve which is effective in ventilating residual air in the hydraulic circuit.

A still further object of the invention is to provide a pressure control valve which can minimize influence of residual air in damping of vibration of a valve spool, which vibration is caused by dither current.

In order to accomplish aforementioned objects in a pressure control valve, according to the present invention, a filter member is disposed in a feedback path for feeding back of fluid pressure in a corresponding control port to a pilot chamber for feedback controlling a position of a valve spool in cooperation with an electric or electromagnetic actuator. The filter member is so arranged as to remove foreign matter. The filter member also serves for regulating fluid flow in the feedback path.

The present invention is also directed to ventilation of air introduced into the hydraulic circuit or in the pressure control valve during assembling of the pressure control valve or the hydraulic circuit. Effective ventilation of air can be performed by communicating a plunger receptacle chamber and a chamber defined behind a valve spool.

According to one aspect of the invention, a pressure control valve assembly comprises:

a valve housing defining a valve bore, a first and a second control port respectively connected to first and second loads, an induction port connected to a high pressure side of a fluid pressure source and a drain port connected to a low pressure side of the fluid pressure source;

a valve spool disposed within the valve bore for thrusting movement therein, the valve spool including means for adjusting fluid flow to the first and second control ports in an inversely proportional ratio to each other;

an actuation means, associated with the valve spool for causing a thrusting movement of the valve spool, and responsive to a command representative of pressure distribution between the first and second ports, for exerting an actuation force to the valve spool so as to adjust the fluid flow to the first and second control ports;

a reaction force generating means, associated with the valve spool and responsive to a fluid pressure at one of the first and second control ports introduced through a feedback path defined in the valve spool, for generating a reacting force against the actuation force so as to place the valve spool at a position at which the actuation force and the reacting force balance and at which the commanded pressure distribution is achieved, the feedback path including a first section extending substantially in an axial direction and a second section extending substantially in transverse direction to the axis of the valve spool; and a filter means disposed in the second section of the feedback path at an intersection between the first and second sections.

According to another aspect of the invention, a pressure control valve assembly comprises:

a valve housing defining a valve bore, at least one control port connected to at least one first load, an induction port connected to a high pressure side of a fluid pressure source and a drain port connected to a low pressure side of the fluid pressure source;

a valve spool disposed within the valve bore for thrusting movement therein, the valve spool including means for adjusting fluid flow to the control port;

an actuation means, associated with the valve spool for causing thrusting movement of the valve spool, and responsive to a command representative of pressure distribution to the control port, for exerting actuation force to the valve spool so as to adjust the fluid flow to the control port;

a reaction force generating means, associated with the valve spool and responsive to a fluid pressure at the control port for generating a reacting force against the actuation force so as to place the valve spool at a position at which the actuation force and the reacting force balances and at which the commanded pressure distribution is achieved.

The actuation means may comprise a first actuator associated with a first axial end of the valve spool for exerting a first actuation force in a first direction and a second actuator associated with a second axial end of the valve spool for exerting a second actuation force in a second direction opposite to the first direction, and the reaction force generating means comprises a first reaction means associated with the other axial end of the valve spool and generating a first reacting force in the second direction reacting against a first actuation force, and a second reaction means associated with the one axial end of the valve spool and generating a second reacting force in the first direction reacting against the second actuation force. In such case, the feedback path comprises a first feedback path including the first and second sections and connecting the first control port to the first reaction means and a second feedback path including the first and second sections and connecting the second control port to the second reaction means.

The pressure control valve may control the fluid pressure at the control port for varying in a linearly proportional relationship to the actuation force. In this case, the pressure control valve may determine the fluid pressure at the control port by the actuation force and the reacting force.

According to a further aspect of the invention, a pressure control valve assembly comprises:

a valve housing defining a valve bore, first and second control ports respectively connected to first and second loads, an induction port connected to a high pressure side of a fluid pressure source and a drain port connected to a low pressure side of the fluid pressure source;

a valve spool disposed within the valve bore for thrusting movement therein, the valve spool including means for adjusting fluid flow to the first and second control ports in inversely proportional relationship to each other, the valve spool defining a first chamber communicated with the drain port;

an actuation means, housed within a second chamber while maintaining clearance between the periphery of the second chamber, associated with the valve spool for causing thrusting movement of the valve spool, and responsive to a command representative of pressure distribution between the first and second ports, for exerting an actuation force to the valve spool so as to adjust the fluid flow to the first and second control ports;

a reaction force generating means, associated with the valve spool and responsive to a fluid pressure at one of the first and second control ports introduced through a feedback path defined in the valve spool, for generating a reacting force against the actuation force so as to place the valve spool at a position, at which the actuation force and the reacting force balance and at which the commanded pressure distribution is achieved, the feedback path including a first section extending substantially in an axial direction and a second section extending substantially in a transverse direction to the axis of the valve spool; and a communication means for defining a communication path in order to establish fluid communication between the first and second chambers so that the residual air in the second chamber can be removed with the residual air in the first chamber.

In the preferred construction, the pressure control valve assembly may further comprise a flow restriction means disposed within the communication path for restricting fluid flow therethrough. Also, the pressure control valve assembly may further comprise means for generating the command in a form of electric current signal, which command generating means superimposing a dither current on the electric current signal for inducing oscillation of the valve spool for reduction of frictional resistance of thrusting movement of the valve spool.

According to a still further aspect of the invention, a steering system for rear wheels of an automotive vehicle comprises:

a steering mechanism associated with rear wheels and hydraulically operable for causing a toe angle change of the rear wheels;

a pressure control valve assembly associated with the steering mechanism for supplying hydraulic control pressure for the steering mechanism, the pressure control valve assembly comprising:

a valve housing defining a valve bore, first and second control ports respectively connected to first and second loads, an induction port connected to a high pressure side of a fluid pressure source and a drain port connected to a low pressure side of the fluid pressure source;

a valve spool disposed within the valve bore for thrusting movement therein, the valve spool including means for adjusting fluid flow to the first and second control ports in a ratio which is inversely proportional to each other;

an actuation means, associated with the valve spool for causing thrusting movement of the valve spool, and responsive to a command representative of pressure distribution between the first and second ports, for exerting an actuation force to the valve spool so as to adjust the fluid flow to the first and second control ports;

a reaction force generating means, associated with the valve spool and responsive to a fluid pressure at one of the first and second control ports introduced through a feedback path defined in the valve spool, for generating reacting force against the actuation force so as to place the valve spool at a position at which the actuation force and the reacting force balance and at which the commanded pressure distribution is achieved, the feedback path including a first section extending substantially in an axial direction and a second section extending substantially in a direction transverse to the axis of the valve spool; and a filter means disposed in the second section of the feedback path at an intersection between the first and second sections.

According to a yet further aspect of the invention, a steering system for rear wheels of an automotive vehicle comprises:

a steering mechanism associated with rear wheels and hydraulically operable for causing a toe angle change of the rear wheels;

a pressure control valve assembly associated with the steering mechanism for supplying a hydraulic control pressure for the steering mechanism, the pressure control valve assembly comprising:

a valve housing defining a valve bore, first and second control ports respectively connected to first and second loads, an induction port connected to a high pressure side of a fluid pressure source and a drain port connected to a low pressure side of the fluid pressure source;

a valve spool disposed within the valve bore for thrusting movement therein, the valve spool including means for adjusting fluid flow to the first and second control ports in a manner which is inversely proportional to each other, the valve spool defining a first chamber communicated with the drain port;

an actuation means, housed within a second chamber while maintaining a clearance between the periphery of the second chamber, associated with the valve spool for causing a thrusting movement of the valve spool, and responsive to a command representative of pressure distribution between the first and second ports, for exerting an actuation force to the valve spool so as to adjust the fluid flow to the first and second control ports;

a reaction force generating means, associated with the valve spool and responsive to a fluid pressure at one of the first and second control ports introduced through a feedback path defined in the valve spool, for generating a reacting force against the actuation force so as to place the valve spool at a position at which the actuation force and the reacting force balance and at which the commanded pressure distribution is achieved, the feedback path including a first section extending substantially in an axial direction and a second section extending substantially in a direction transverse to the axis of the valve spool; and a communication means for defining a communication path in order to establish a fluid communication between the first and second chambers so that the residual air in the second chamber can be removed with the residual air in the first chamber.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
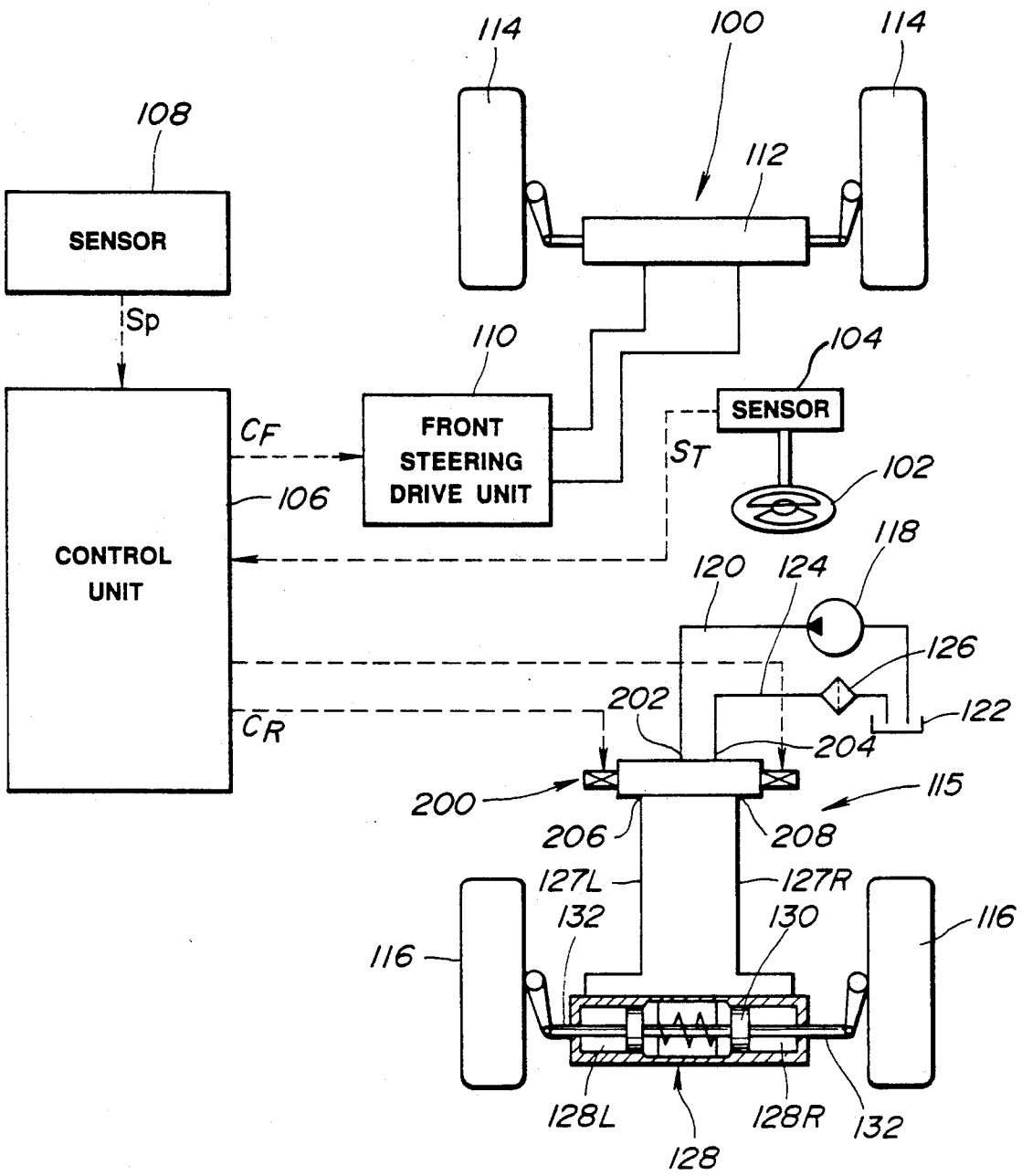
FIG. 1 is a circuit diagram of the preferred embodiment of a rear wheel steering system employing the preferred embodiment of the pressure control valve of FIG. 1.

Referring now to the drawings, particularly to FIG. 1, the preferred embodiment of a pressure control valve according to the present invention, will be discussed herebelow in terms of application for an automotive steering system which has a capability of causing steering at rear wheels. In general, the shown automotive steering system includes a front wheel steering control mechanism and a rear wheel steering control mechanism. The front wheel steering control mechanism 100 includes a steering wheel 102 to be operated by a vehicular driver. A steering angle sensor 104 is associated with a steering column for monitoring angular position of the steering wheel or steering shaft for producing a steering angle indicative signal St. The steering angle sensor 104 is connected to a control unit 106 which comprises a microprocessor. The control unit 106 is also connected to a steering control parameter sensor unit 108 which consists of a plurality of sensors respectively designed and arranged for vehicular driving parameters affecting vehicular driving characteristics. The steering control parameter sensor unit 108 outputs the control parameter indicative sensor signals Sp to be input to the control unit 106. The control unit 106 receives the steering angle indicative signal St and the control parameter indicative sensor signals Sp for processing and for producing a front steering control signal. The control unit 106 outputs the front steering control signal $C_F$ to a front steering driver unit 110 for controlling operation thereof. The front steering drive unit 110 is responsive to the front steering control signal $C_F$ for driving a steering unit 112, such as a power cylinder so as to cause steering at front wheels 114.

On the other hand, the control unit 106 is also connected to a pressure control valve 200 for implementing the present invention. The pressure control valve 200 too is disposed within a hydraulic circuit for a rear wheel steering system 115 for controlling steering of rear wheels 116. The hydraulic circuit includes a fluid pump 118 connected to an induction port 202 of the pressure control valve 200 for supplying a pressurized working fluid thereto via a supply line 120, a fluid reservoir 122 connected to a drain port 204 of the pressure control valve via a drain line 124 and a filter 126, and a pair of control lines 127L and 127R respectively connected to a pair of control ports 206 and 208 and to left and right side working chambers 128L and 128R of a power cylinder 128. The power piston 130 is disposed within the power cylinder 128 for causing lateral and thrusting movement. The power piston 128 is connected to left and right rear wheels 116 via a piston rod 132 for causing steering of the rear wheels according to the pressure difference within the left and right side working chambers 126L and 126R.

The control unit 106 derives the rear wheel steering magnitude on the basis of the control parameter indicative sensor signals Sp and the steering angle indicative signal St and thus produces a rear wheel steering control signal $C_R$ for controlling a valve position of the pressure control valve 200, thereby controlling the steering angle of the rear wheels 116.

Figure 2:
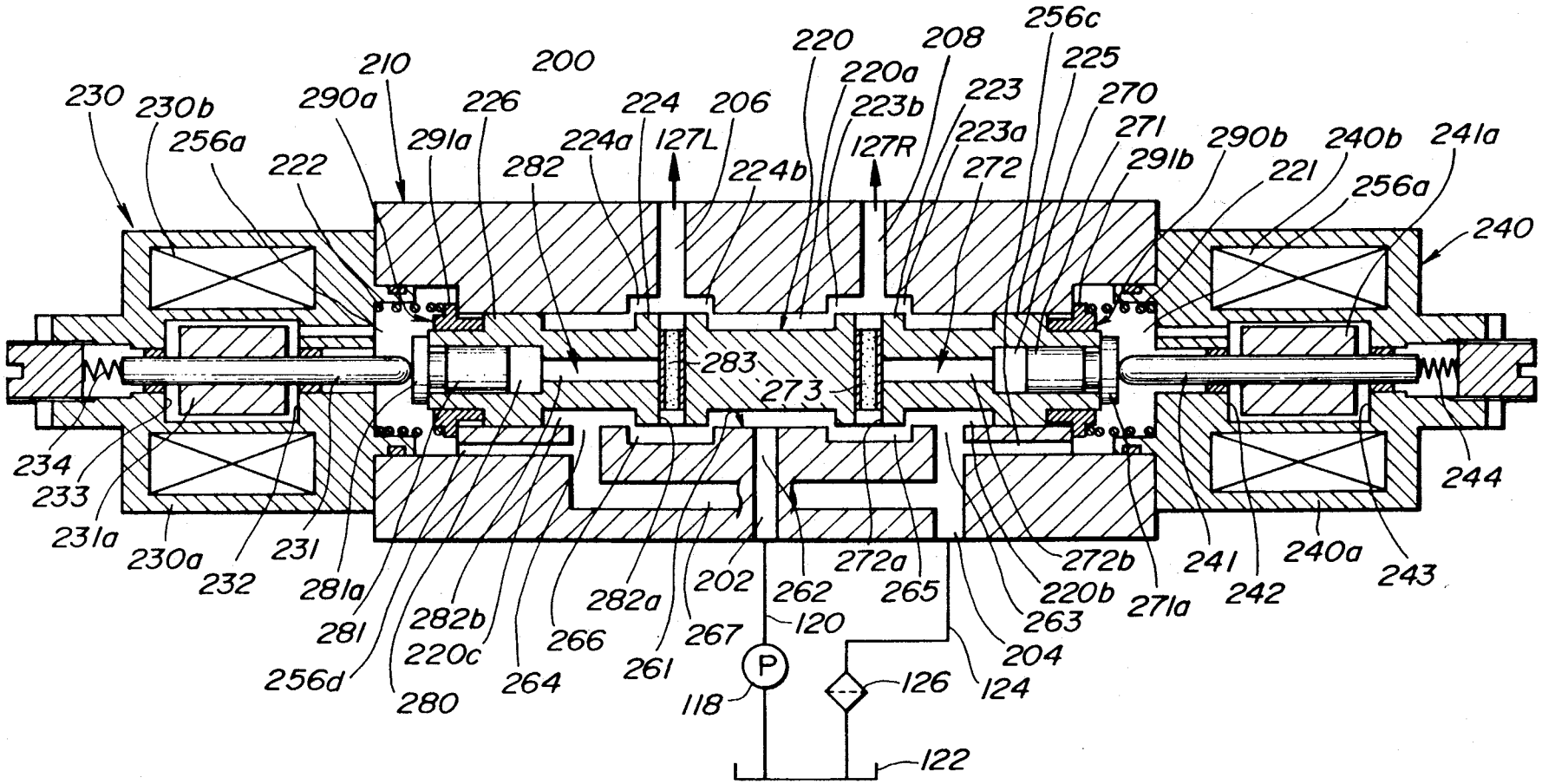
FIG. 2 is a section of the preferred embodiment of a pressure control valve according to the present invention employed in the rear wheel steering system of FIG. 1.

FIG. 2 shows the preferred embodiment of the pressure control valve 200 which is suitable for use in the aforementioned rear wheel steering system. The pressure control valve 200 includes an essentially hollow cylindrical valve body 210, in which is disposed a valve spool 220. The pressure control valve 200 defines chambers **230*b* and 240*b* at both axial ends of the valve body 210. A pair of electromagnetic actuators 230 and 240 are disposed in respective receptacle chambers 230*b* and 240*b*** while maintaining clearance from the peripheral surface of the receptacle chamber.

The valve body 210 defines a valve bore 261. The valve body 210 also defines the induction port 202, the drain port 204 and a pair of control ports 206 and 208. The induction port 202 is communicated with the valve bore 261 at an opening 262. The drain port 204 is also communicated with the valve bore 261 via openings 263 and 264. The drain port opening 264 is connected to the drain port via a drain path 267. Further, the control ports 206 and 208 are communicated with the valve bore 261 via openings 265 and 266, respectively. As can be seen from FIG. 2, the open 262 communicating the valve bore 261 to the induction port 202 is oriented essentially at the transverse center position. On the other hand, the openings 263 and 264 connecting the valve bore 261 to the drain ports 204 are oriented in the vicinity of both axial ends. The annular grooves 265 and 266 respectively connecting the valve bore 261 to the control ports 206 and 208 are oriented intermediate positions between the induction port opening 262 and the drain port opening 263 and between the induction port opening 262 and the drain port opening 264.

The valve spool 220 is biased by means of a pair of coil springs 221 and 222 so that it may be placed at a neutral position in a normal state. The valve spool 220 is formed with annular lands 223, 224 respectively opposing the control port grooves 265 and 266. The annular lands 223 and 224 define an annular groove **220*a* opposing the induction port opening 262. The valve spool 220 is also formed with annular lands 225 and 226 for defining an annular groove 220*b* between the lands 225 and 223 and an annular groove 220*c* between lands 226 and 224. Respectively, the annular grooves 220*b* and 220*c* are oriented in opposition with the drain port openings 263 and 264**.

The land 223 forms variable orifices **223*a* and 223*b* with shoulders of the annular groove 265. Likewise, the land 224 forms variable orifices 224*a* and 224*b* with shoulders of the annular groove 266. The variable orifices 223*a* and 223*b* cooperatively vary the path area depending upon the axial position of the valve spool 220. Namely, at the neutral position of the valve spool 220, the path areas of the variable orifices 223*a* and 223*b* are equal to each other. Therefore, at this position, later working fluid flows into the grooves 220*a* and 220*b*. From this neutral position, by shifting the valve spool toward the left in FIG. 2, the path area of the variable orifice 223*a* is decreased for reducing the working fluid flow rate therethrough and the path area of the variable orifice 223*b* is increased for increasing the working fluid flow rate therethrough. Similarly, the variable orifices 224*a* and 224*b*** are so situated to cause a variation of working fluid flow in an inversely proportional fashion.

Between actuator housings **230*a* and 240*a* and the axial ends of the valve spool 220, chambers 256*a* and 256*b* are defined. The chamber 256*a* is communicated with the drain port 204 via an axial path 256*c*. On the other hand, the chamber 256*b* is communicated with the drain path 267 via an axial path 256*d***.

The chamber **256*a* is communicated with the actuator receptacle chamber 230*c* and 240*c* via a communication path 256*e*. By communicating the chambers 256*a* and chambers 230*c* and 240*c*, ventilation of residual air can be performed simultaneously for both of the chambers 256*a*, 230*c* and 240*c***.

First and second axially extending piston bores 270 and 280 are formed through the valve spool 220. The piston bore 270 is communicated with the annular groove 265 via a feedback path 272. A pilot piston 271 with a stopper flange **271*a* is slidably disposed within the piston bore 270. Similarly, the piston bore 280 is communicated with the annular groove 266 via feedback path 282. A pilot piston 281 with a stopper flange 281*a* is slidably disposed within the piston bore 280. The feedback path 272 includes a transverse path section 272*a* which extends transversely with respect to the axis of the valve spool 220 and an axial path section 272*b*. Similarly, the feedback path 282 includes a transverse path section 282*a* and an axial path section 282*b*. Filters 273 and 283 are disposed within the transverse path sections 272*a* and 282*a* so as to cover the junction between the transverse path sections and the axial path sections 272*b* and 282*b*. These filters 273 and 283 are disposed in the transverse path sections 272*a* and 282*a*** with firm engagement with the peripheral wall and designed for filtering the foreign matter, such as dust, dirt and so forth, contained in the working fluid.

Though the shown embodiment installs the filters with firm engagement with the peripheral walls of the transverse path sections, it may be possible to form the filters to be loosely installed in the associated path section and retained in opposition with the axial path section by means of an appropriate retainer.

Annular retainers 290*a* and 290*b* are provided in the vicinity of the axial ends of the valve bore 261 in a manner movable in an axial direction. To the retainers 290*a* and 290*b*, inner ends of springs 221 and 222 are seated for biasing the retainers toward the axial ends of the valve spool 220. Therefore, the retainers 290*a* and 290*b* are held constantly in contact with the axial ends of the valve spool 220. The retainers 290*a* and 290*b* are provided with flanges 291*a* and 291*b* which serve as the spring seat for receiving the inner ends of the springs 221 and 222. When the valve spool 220 is shifted in a direction away from one of the retainers, one of the flanges 291*a* and 291*b* associated with the one retainer comes into contact with the shoulder of the valve bore to be restricted in its axial movement.

The electromagnetic actuators 230 and 240 which comprise solenoids, are provided at both axial ends of the valve housing. The actuators 230 and 240 have plungers 231 and 241 which are in contact with the outer ends of the pilot pistons 271 and 281 at its inner ends. The solenoid coils 230*b* and 240*b* of the actuators 230 and 240 are connected to the control unit 106 to receive therefrom control currents $i_1$ and $i_2$ to control the operation thereof. The solenoid coils 230*b* and 240*b* are provided with primary electromagnetic characteristics with respect to the control currents $i_1$ and $i_2$. The plungers 231 and 241 have bulged sections 231*a* and 241*a* housed within the actuator housings 230*a* and 240*a* in opposition to the solenoid coils 230*b* and 240*b*. These bulged sections 231*a* and 241*a* oppose shoulders 232, 233 and 242, 243 serving as stopper surfaces, at axial ends thereof. On the other hand, the plungers 231 and 241 are resiliently biased toward the valve spool 220 by means of coil springs 234 and 244.

With the construction set forth above, when both of the actuators 230 and 240 are held inoperative, the valve spool 220 is biased at the neutral position by means of the pair of coil springs 221 and 222. While the valve spool 220 is maintained at the neutral position, a dither current is applied to the actuators 230 and 240 for inducing a substantially small magnitude and high frequency vibration on the valve spool via the actuators. The vibration due to application of the dither current may reduce resistance against thrusting movement of the valve spool as actuated. At this valve position, the high pressure working fluid introduced into the valve bore 261 via the induction port 202 flows through the drain ports 204 for returning the fluid to the fluid reservoir 122 via the drain line 124. At this time, since the fluid pressures at the control ports 265 and 266 are maintained equal to each other. Therefore, the fluid pressures in the working chambers 128L and 128R of the power cylinder 128 are maintained equal to each other. Therefore, the rear wheels 116 are held at the neutral or straight position.

Figure 3:
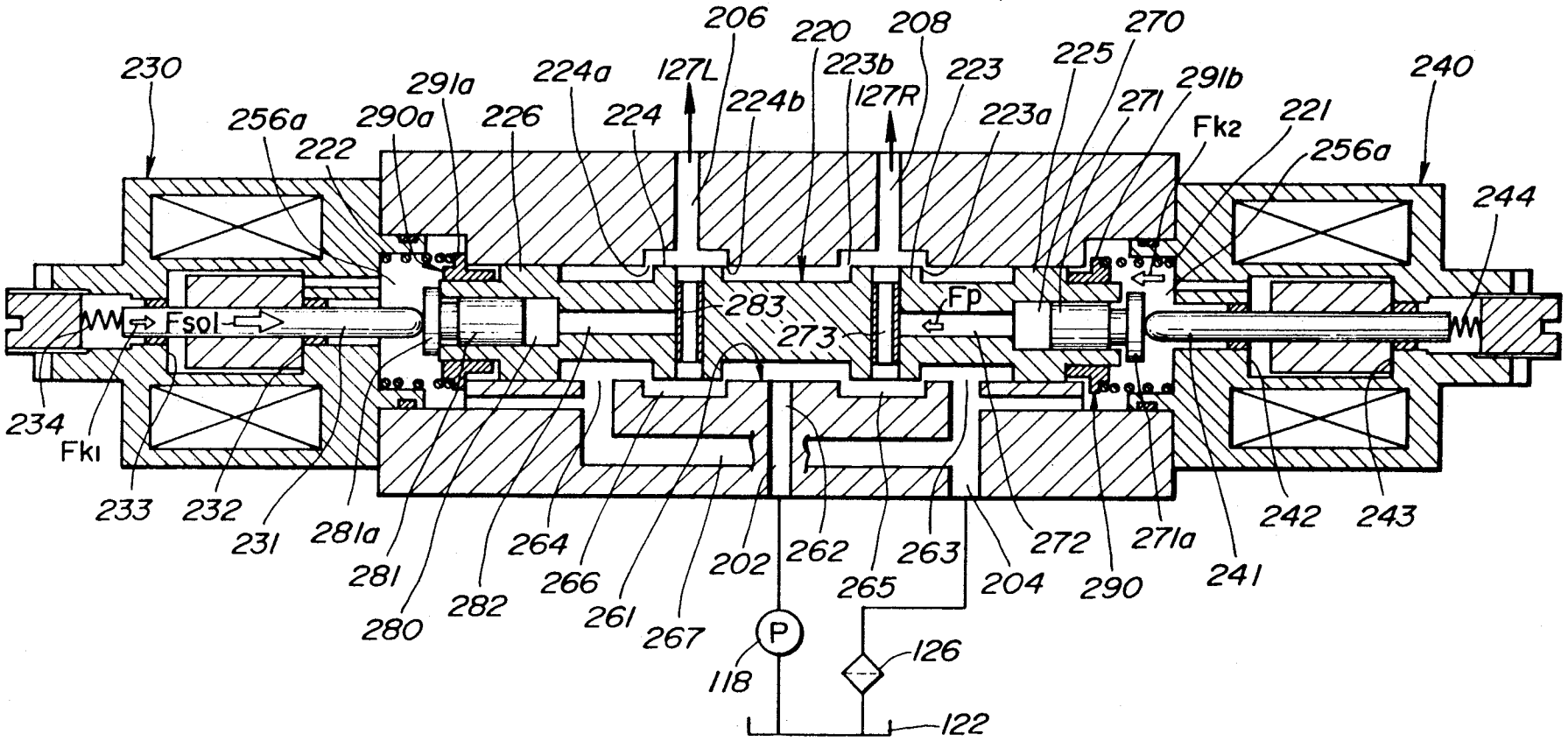
FIG. 3 is a section similar to FIG. 2 but showing a valve position in which pressure distribution is controlled for different pressure in different control ports.
Figure 4:
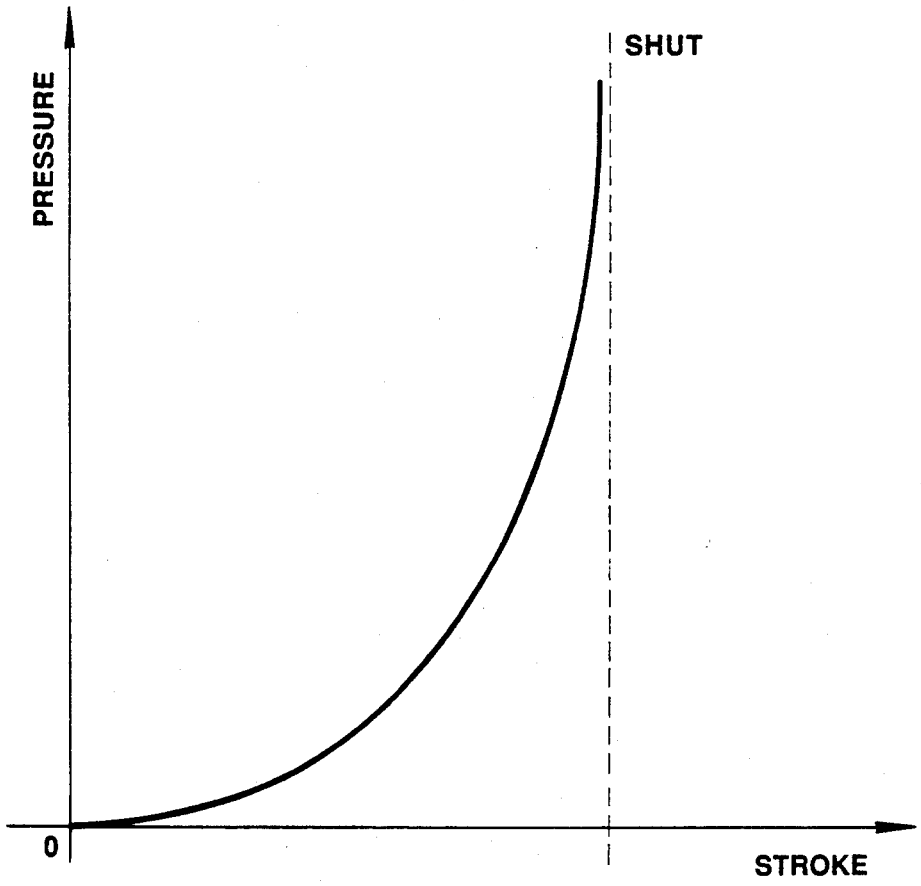
FIG. 4 is a graph showing variation of the control pressure in the conventional pressure control valve.

On the other hand, when the control current $i_1$ is applied to the actuator 230, the solenoid coil 230*a* is energized to exert an actuation force Fsol so as to shift the plunger 231 toward the right in FIG. 2 and thereby cause shifting of the valve spool 220 against the spring force of the coil spring 221, as shown in FIG. 3. As can be seen from FIG. 3, by a right hand shifting of the valve spool 220, the variable orifices 223*a* for fluid communication between the annular groove 265 and the annular groove 263, and the variable orifice 224*b* for fluid communication between the annular groove 220*a* and the annular groove 266 are reduced and the path area is somewhat shut. On the other hand, at the same time, the variable orifice 223*b* for fluid communication with the annular groove 220*a* and the annular groove 265 and the variable orifice 224*a* for fluid communication between the annular chamber 220*c* and the annular groove 266 increase the path area. Therefore, the fluid pressure in the control port 208 is increased by connecting the induction port 202 thereto and the fluid pressure in the control port 206 is decreased by an increased flow rate of fluid communication with the drain port.

At the same time, due to an increasing of the fluid pressure in the annular chamber 265, part of the high pressure working fluid flows through the feedback path 272 and through the filter 273 and is introduced into the piston bore 270. This fluid pressure in the piston bore 270 acts on the pilot piston 271 to cause an axial and outward shifting of the latter to project the pilot piston from the axial end of the piston bore. By this, the plunger 241 is shifted to the right in FIG. 3 until the axial end of the bulged section 241*a* comes into contact with the shoulder 243. A force reacting upon the force exerted on the pilot piston 270 serves as a feedback pressure Fp for the valve spool 220 so as to urge the valve spool toward the left in FIG. 3. Therefore, the force balance is established at the position, at which the following equation can be satisfied:

$$Fsol+FK_1\omega Fp+FK_2$$

where $FK_1$ is a force of spring 234;

$FK_2$ is a force of spring 221

By this, the fluid pressure in the control port 208 is maintained at a pressure level corresponding to that represented by the control current $i_1$. At this time, the relationship between electromagnetic force Fsol to be applied for the plunger 231 and the feedback force Fp can be illustrated by:

$$Fp=Fsol+FK_1-FK_2$$

and thus can be linearly proportional.

It is preferable to set the spring forces of the coil springs 221, 222 and the coil springs 234 and 244 to be equal to each other.

By the action of the valve spool as set forth above, the fluid pressure in the right side working chamber 128R is increased to cause shifting of the piston 130 toward the left to cause right hand steering at the rear wheels 116.

Similar action can be take place in response to the control current $i_2$ for left hand steering for the rear wheels 116. In the left hand steering operation, the spring forces of the coil springs 222 and 244 and the reacting force exerted to the valve spool through the action of the pilot piston 281 establish the force balance to adjust the fluid pressure in the control port 206 at a pressure level corresponding to that commanded by the control current $i_2$.

When the actuation force of one of the actuators 230 and 240 is released, both of the pilot pistons 271 and 281 are returned to the initial and fully inserted position by means of the coil springs 234 and 244.

It should be noted that, between the piston bores 270 and 280, a small amount of working fluid is maintained to leak into the chambers 256*a* and 256*b* through a substantially small gap formed between the outer periphery of the pilot pistons 271 and 281 and the inner periphery of the piston bores 270 and 280. During fluid flow through the feedback path 272, the dust, dirt and other foreign matter can be removed by means of the filter. At this time, since the fluid pressures at both sides of the filters 273 and 283 are equal to each other, the filter is prevented from axial shifting from the initial position. Furthermore, since the fluid pressure of the leaking fluid is exerted in a shearing direction with respect to the filter, the filters 273 and 283 may not cause offsetting from the initially set position.

It should be noted that since the leak amount of the working fluid through the piston bore 270 and 280 is substantially small, a pressure loss may not seriously affect a pressure control valve operation even when the high density filter is used.

As can be seen herefrom, since the shown embodiment of the pressure control valve determines the fluid pressure by a pressure balance between the electromagnetic actuation force of the electromagnetic actuator and the feedback force irrespective of the magnitude of stroke of the valve spool, it becomes possible to control the fluid pressure corresponding to the electromagnetic characteristics of the actuator. As set forth, since the control current $i_1$ and $i_2$ may vary according to linear characteristics, the control pressure to be generated by the shown embodiment of the pressure control valve becomes linearly proportional to the control current. Therefore, activity of the power cylinder for the rear wheel steering system becomes linearly correspond to the control current. This permits precise control of the rear wheel steering system as applied.

In addition, since the shown embodiment which houses the feedback fluid path is defined within the valve spool a valve body can be made much more compact in comparison with that in the prior art. Furthermore, since the feedback force is generated within the valve spool instead of the axial end chamber, the flow direction of the leaking fluid becomes constant. This makes operation of the pressure control valve stable. Also, since the shown embodiment of the pressure control valve employs the filters in the feedback path for removing substantially small foreign matters, such as dust, dirt, chips and so forth, a smooth and steady operation of the pilot piston can be assured for a long period.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Figure 5:
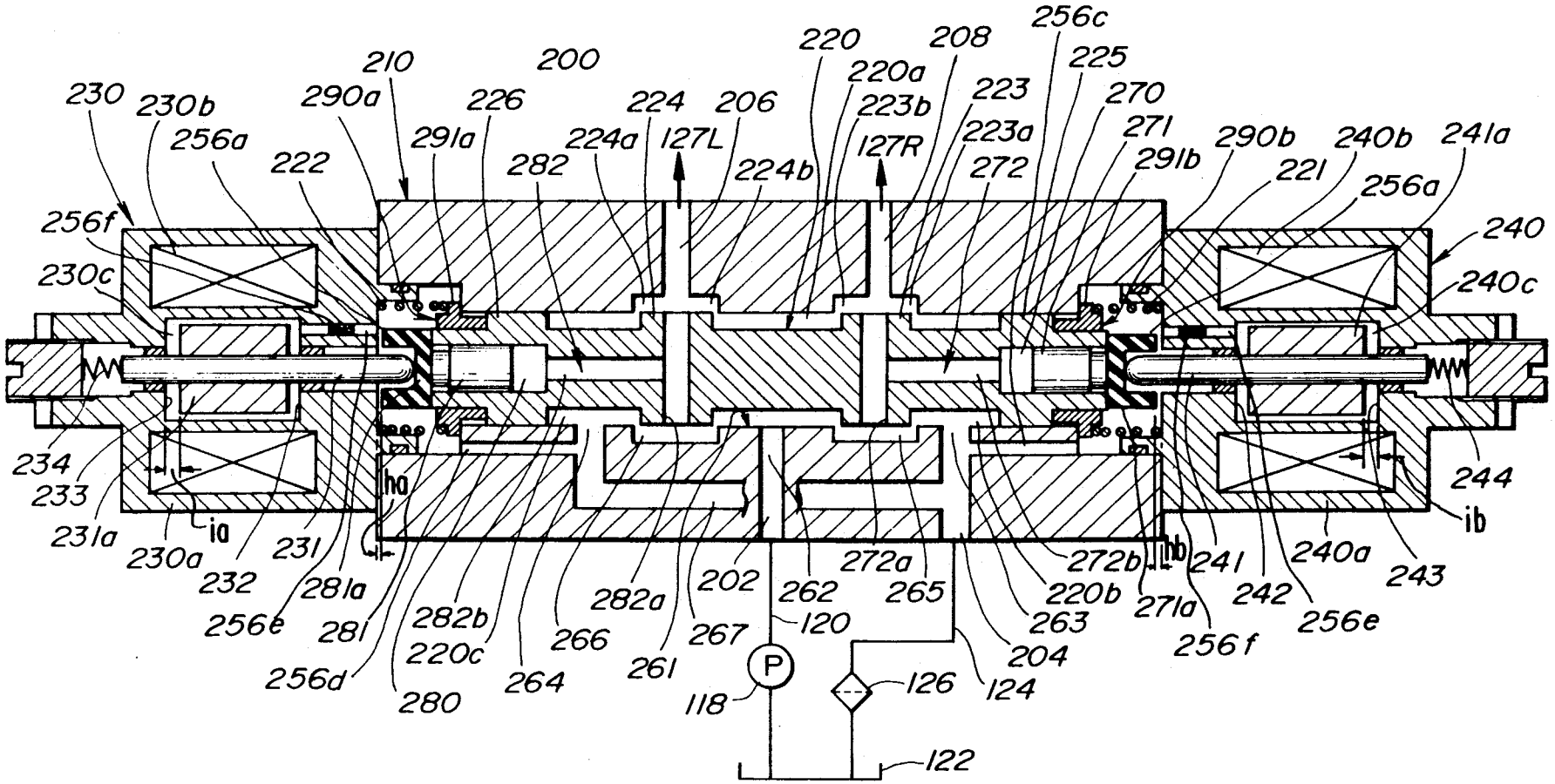
FIG. 5 is a section of a modification of the preferred embodiment of a pressure control valve according to the present invention employed in the rear wheel steering system of FIG. 1.

FIG. 5 shows a modification of the pressure control valve according to the invention. In this modification, flow restriction orifices 256*f* are disposed within the communication path 256*e* which communicates the actuator receptacle chamber 230*c* and 240*c* and the chamber 256*a*. The orifice 256*f* is preferably in a size of 0.3 mm to 0.6 mm in diameter. Such size is preferred so as to provide a sufficiently high efficiency of ventilation of residual air in the pressure control valve and to prevent the air in the chamber 230*c*, 240*c* from entering into the actuator receptacle chamber 256*a*. The orifices 256*f* are effective for suppression of pressure variation when the valve spool 220 is oscillated or vibrated by application of the dither current. In addition, in the shown embodiment, the stopper flange 271*a* in the former embodiment is replaced with the shown essentially cup-shaped configuration while leaven a reduced magnitude of clearance between the mating surface of the actuator housing 230*a* and 240*a* in a width of ha and hb. In the preferred construction, the cup-shaped stopper flange 271*a* is formed of a synthetic resin. This clearance cooperate with the clearance ia and ib between the buldge section 231*a* and 241*a* of the actuators for permitting vibration of the valve spool 220 by application of the dither current.

What is claimed is:

1. A pressure control valve assembly comprising:

a valve housing defining a valve bore, first and second control ports respectively connected to first and second loads, an induction port connected to a high pressure side of a fluid pressure source and a drain port connected to a low pressure side of said fluid pressure source;

a valve spool disposed within said valve bore for thrusting movement therein, said valve spool including means for adjusting fluid flow to said first and second control ports in a manner which is inversely proportional to each other;

an actuation means, associated with said valve spool for causing thrusting movement of said valve spool, and responsive to a command representative of pressure distribution between said first and second ports, for exerting an actuation force to said valve spool so as to adjust the fluid flow to said first and second control ports;

a reaction force generating means, associated with said valve spool and responsive to a fluid pressure at one of said first and second control ports introduced through a feedback path defined in said valve spool, for hydraulically generating a reacting force against said actuation force and varying according to a stroke of said valve spool so as to place said valve spool at a position at which said actuation force and said reacting force balance and at which said commanded pressure distribution is achieved, said feedback path including a first section extending substantially in an axial direction and a second section extending substantially in a direction transverse to the axis of said valve spool; and a filter means disposed in said second section of said feedback path at an intersection between said first and second sections.

2. A pressure control valve assembly as set forth in claim 1, wherein said actuation means comprises a first actuator associated with a first axial end of said valve spool for exerting a first actuation force in a first direction and a second actuator associated with a second axial end of said valve spool for exerting a second actuation force in a second direction opposite to said first direction and wherein said reaction force generating means comprises a first reaction means associated with the second axial end of said valve spool and generating a first reacting force in said second direction reacting against a first actuation force, and a second reaction means associated with said first axial end of said valve spool and generating a second reacting force in said first direction reacting against said second actuation force.

3. A pressure control valve as set forth in claim 2, wherein said feedback path comprises a first feedback path including said first and second sections and connecting said first control port to said first reaction means and a second feedback path including said first and second sections and connecting said second control port to said second reaction means.

4. A pressure control valve as set forth in claim 1, further including means for variably controlling the fluid pressure at said control port in a linearly proportional relationship to said actuation force.

5. A pressure control valve as set forth in claim 4, wherein said valve determines said fluid pressure at said control port by said actuation force and said reacting force.

6. A pressure control valve assembly comprising:

a valve housing defining a valve bore, at least one control port connected to at least one load, an induction port connected to a high pressure side of a fluid pressure source and a drain port connected to a low pressure side of said fluid pressure source;

a valve spool disposed within said valve bore for thrusting movement therein, said valve spool including means for adjusting fluid flow to said control port;

an actuation means, associated with said valve spool for causing thrusting movement of said valve spool, and responsive to a command representative of pressure distribution to said control port for exerting an actuation force to said valve spool so as to adjust the fluid flow to said control port;

a reaction force generating means, associated with said valve spool and responsive to a fluid pressure at said control port for generating a reacting force varying according to variation of the fluid pressure at said control port and reacting against said actuation force so as to place said valve spool at a position where said actuation force and said reacting force balance and at which said commanded pressure distribution is achieved, said reacting force being cooperative with said actuation force for establishing a linear variation of fluid pressure to be distributed through said control port in relation to variation of said actuation force; and said reacting force generating means is connected to said control port via a feedback path including a first section extending substantially in an axial direction and a second section extending substantially in a direction transverse to the axis of said valve spool, and a filter means disposed in said second section of said feedback path at an intersection between said first and second sections.

7. A pressure control valve assembly as set forth in claim 6, wherein said actuation means comprises a first actuator associated with a first axial end of said valve spool for exerting a first actuation force in a first direction and a second actuator associated with a second axial end of said valve spool for exerting a second actuation force in a second direction opposite to said first direction, and said reaction force generating means comprise a first reaction means associated with said the second axial end of said valve spool and generating a first reacting force in said second direction reacting against a first actuation force, and a second reaction means associated with said first axial end of said valve spool and generating a second reacting force in said first direction reacting against said second actuation force.

8. A pressure control valve as set forth in claim 7, wherein said feedback path comprises a first feedback path including said first and second sections and connecting said first control port to said first reaction means and a second feedback path including said first and second sections and connecting said second control port to said second reaction means.

9. A pressure control valve as set forth in claim 6, further including means which variably controls the fluid pressure at said control port in a linearly proportional relationship to said actuation force.

10. A pressure control valve as set forth in claim 9, wherein said valve determines said fluid pressure at said control port by said actuation force and said reacting force.

11. A pressure control valve assembly comprising:

a valve housing defining a valve bore, first and second control ports respectively connected to first and second loads, an induction port connected to a high pressure side of a fluid pressure source and a drain port connected to a low pressure side of said fluid pressure source;

a valve spool disposed within said valve bore for axial movement therein, said valve spool including means for adjusting fluid flow to said first and second control ports in a manner which is inversely proportional to each other, said valve spool and said valve bore defining a first chamber at one end of said valve spool communicated with said drain port;

an actuation means having a first portion housed within a second chamber while maintaining clearance between the periphery of said second chamber and a second portion extending from said first portion into said first chamber for causing axial movement of said valve spool, said actuation means being responsive to a command representative of pressure distribution between said first and second ports for exerting an actuation force on said valve spool so as to adjust the fluid flow to said first and second control ports;

a reaction force generating means, associated with said valve spool and responsive to a fluid pressure at one of said first and second control ports which is introduced into a feedback path defined in said valve spool, for generating a reacting force which acts against said actuation force and which varies according to a stroke of said valve spool so as to place said valve spool in a position at which said actuation force and said reacting force balance and at which said commanded pressure distribution is achieved, said feedback path including a first section extending substantially in an axial direction and a second section extending substantially in a direction transverse to the axis of said valve spool; and a communication path defining a fluid communication between said first and second chambers, said communication path having a flow restriction orifice disposed therein between said first and second chambers to provide a constant restricted fluid flow path therebetween.

12. A steering system for rear wheels of an automotive vehicle comprising:

a steering mechanism associated with said rear wheels and hydraulically operable for causing a toe angle change of said rear wheels;

a pressure control valve assembly associated with said steering mechanism for supplying hydraulic control pressure for said steering mechanism, said pressure control valve assembly comprising:

a valve housing defining a valve bore, first and second control ports respectively connected to first and second loads, an induction port connected to a high pressure side of a fluid pressure source and a drain port connected to a low pressure side of said fluid pressure source;

a valve spool disposed within said valve bore for thrusting movement therein, said valve spool including means for adjusting fluid flow to said first and second control ports in a manner which is inversely proportional to each other;

an actuation means, associated with said valve spool for causing thrusting movement of said valve spool, and responsive to a command representative of pressure distribution between said first and second ports, for exerting an actuation force to said valve spool so as to adjust the fluid flow to said first and second control ports;

a reaction force generating means, associated with said valve spool and responsive to a fluid pressure at one of said first and second control ports introduced through a feedback path defined in said valve spool, for hydraulically generating a reacting force against said actuation force and varying according to a stroke of said valve spool so as to place said valve spool at a position at which said actuation force and said reacting force balance and at which said commanded pressure distribution is achieved, said feedback path including a first section extending substantially in an axial direction and a second extending substantially in a direction transverse to the axis of said valve spool; and a filter means disposed in said second section of said feedback path at an intersection between said first and second sections.

* * * * *